US007641775B2

(12) United States Patent
Yang et al.

(10) Patent No.: US 7,641,775 B2
(45) Date of Patent: Jan. 5, 2010

(54) APPARATUS FOR MANUFACTURING ELECTROLYTIC METAL FOIL

(75) Inventors: Jin-Kyu Yang, Gyeonggi-do (KR); Yoea-Sang Yoon, Seoul (KR); Jong-Seo Yoon, Seoul (KR)

(73) Assignee: LS Mtron Ltd., Anyang (KR)

( * ) Notice: Subject to any disclaimer, the term of this patent is extended or adjusted under 35 U.S.C. 154(b) by 755 days.

(21) Appl. No.: 11/330,517

(22) Filed: Jan. 11, 2006

(65) Prior Publication Data

US 2006/0151315 A1 Jul. 13, 2006

(30) Foreign Application Priority Data

Jan. 12, 2005 (KR) ..... 10-2005-0003049

(51) Int. Cl.
*C25D 17/00* (2006.01)

(52) U.S. Cl. ..... 204/202; 204/206

(58) Field of Classification Search ..... 204/199, 204/202, 206; 205/67, 76, 77, 138
See application file for complete search history.

(56) References Cited

U.S. PATENT DOCUMENTS 3,619,400 A * 11/1971 Eisner ..... 204/216
4,073,699 A * 2/1978 Hutkin ..... 205/50
4,686,016 A * 8/1987 Held ..... 205/132
5,236,572 A * 8/1993 Lam et al. ..... 205/75
6,153,077 A * 11/2000 Kato et al. ..... 205/77

FOREIGN PATENT DOCUMENTS

JP 56-139689 10/1981

* cited by examiner

*Primary Examiner*—Nam X Nguyen
*Assistant Examiner*—Luan V Van
(74) *Attorney, Agent, or Firm*—Jones Day

(57) ABSTRACT

Disclosed is an apparatus for manufacturing an electrolytic metal foil, which includes an electrolytic cell containing electrolyte; an upper drum installed in an upper portion of the electrolytic cell to be rotatable and to which a negative potential is applied; a lower drum soaked in the electrolyte of the electrolytic cell and installed to be rotatable together with the upper drum; a cathode belt mounted around outer circumferences of the upper and lower drums to move along an endless track and electrically connected to the upper drum so that the negative potential is applied thereto; and an anode unit installed to form a space from a metal electroplating surface of the cathode belt soaked in the electrolytic cell so that a positive potential is applied thereto, the anode unit having a slit for supplying the electrolytic to the space. This apparatus may increase a production rate of electrolytic metal foils.

7 Claims, 5 Drawing Sheets

APPARATUS FOR MANUFACTURING ELECTROLYTIC METAL FOIL

BACKGROUND OF THE INVENTION

1. Field of the Invention

The present invention relates to an apparatus for manufacturing an electrolytic metal foil, and more particularly to an apparatus for manufacturing an electrolytic metal foil, which may increase an electroplating area in making a metal foil using an electrolytic manner.

2. Description of the Related Art

A copper foil, a kind of electrolytic metal foil, is a basic element used for a printed circuit board (PCB) of electronic parts, and it is generally made using electrolysis. The copper foil made by electrolysis has good purity of electroplated substances though using a cheap electrolyte, and gives uniform thickness over a wide area.

FIG. 1 shows a conventional electrolytic metal foil manufacturing device. Referring to FIG. 1, the conventional electrolytic metal foil manufacturing device includes an electrolytic cell 10 containing electrolyte 11, a cathode drum 20 partially soaked in the electrolytic cell 10, and an anode unit 50 installed around the cathode drum 20 with a space therefrom. The anode unit 50 has a slit 51 so that the electrolyte 11 is supplied to the spaced area between the anode unit 50 and the cathode drum 20 through the slit 51. The conventional electrolytic metal foil manufacturing device is connected to a power source 1. In more detail, the cathode drum 20 is connected to a negative pole of the power source 1, and the anode unit 50 is connected to a positive pole of the power source 1.

With the cathode drum 20 and the anode unit 50 being connected to the power source 1 as mentioned above, if the device starts operation, the cathode drum 20 rotates at a constant speed, and metal ions in the electrolyte 11 is electroplated on the cathode drum 20 soaked in the electrolyte 11. Electroplated substances 2 formed as mentioned above are moved upward above the surface of the electrolyte along with the rotation of the cathode drum 20. After that, the electroplated substances 2 are separated from the cathode drum 20 by means of a separating roll 60, and taken up by a take-up drum 70 installed out of the electrolytic cell 10 to complete an electrolytic metal foil 3.

In the conventional electrolytic metal foil manufacturing device, in order to increase a production rate of electrolytic metal foils, it may be considered that an electroplating amount should be increased by raising the density of current applied to the electrolytic metal foil manufacturing device, or that an electroplating area of the cathode drum 20 is enlarged to increase an electroplating rate. However, it is impossible to increase the density of current without a limit due to the structure of the device, and also a copper foil made by applying a high density of current has inferior quality. Thus, the way of enlarging an electroplating area of the cathode drum 20 should be considered. However, if a diameter of the cathode drum 20 is increased to enlarge the electroplating area of the cathode drum 20, the entire size of the electrolytic metal foil manufacturing device is increased too much, thereby deteriorating the efficiency of space utilization, and also the cost of the device is increased.

SUMMARY OF THE INVENTION

The present invention is designed to solve the problems of the prior art, and therefore it is an object of the present invention to provide an apparatus for manufacturing an electrolytic metal foil, which may increase a production rate of electrolytic metal foils by enlarging an electroplating area of electrolyte without increasing an area occupied by the apparatus under the same density of current.

In order to accomplish the above object, the present invention provides an apparatus for manufacturing an electrolytic metal foil, which includes an electrolytic cell containing electrolyte; an upper drum installed in an upper portion of the electrolytic cell to be rotatable and to which a negative (−) electric potential is applied; a lower drum soaked in the electrolyte of the electrolytic cell and installed to be rotatable together with the upper drum; a cathode belt mounted around outer circumferences of the upper and lower drums to move along an endless track and electrically connected to the upper drum so that the negative (−) electric potential is applied thereto; and an anode unit installed to form a space from a metal electroplating surface of the cathode belt soaked in the electrolytic cell so that a positive (+) electric potential is applied thereto, the anode unit having a slit for supplying the electrolytic to the space.

Preferably, the upper drum is made of conductive titanium, and the lower drum is made of non-conductive ebonite. In addition, the cathode belt may have a thickness of 1 to 3 mm.

The apparatus for manufacturing an electrolytic metal foil according to the present invention may further include a fixing member successively coupled to an entire side end of the cathode belt and slidably contacted with sides of the upper and lower drums.

Preferably, the fixing member is made of non-conductive material, and the fixing member has a section of a '⊂' shape to surround a side of the cathode belt.

In addition, the apparatus for manufacturing an electrolytic metal foil may further include an O-ring interposed in a concave groove formed at a border between the fixing member and an electroplated metal electroplated on the cathode belt. In this case, the apparatus for manufacturing an electrolytic metal foil according to the present invention may further include a first roller for guiding the O-ring to be successively inserted into the concave groove before the cathode belt is soaked in the electrolyte; and a second roller for guiding the O-ring to be successively departed from the concave groove when the cathode belt moves up above a surface of the electrolyte.

Meanwhile, the apparatus for manufacturing an electrolytic metal foil may further include a separating roll installed out of the electrolytic cell to separate the metal electroplated on the cathode belt from the cathode belt; and a take-up drum for taking up the separated electrolytic metal foil.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Hereinafter, preferred embodiments of the present invention will be described in detail referring to the accompanying drawings. Prior to the description, it should be understood that the terms used in the specification and appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Figure 1:
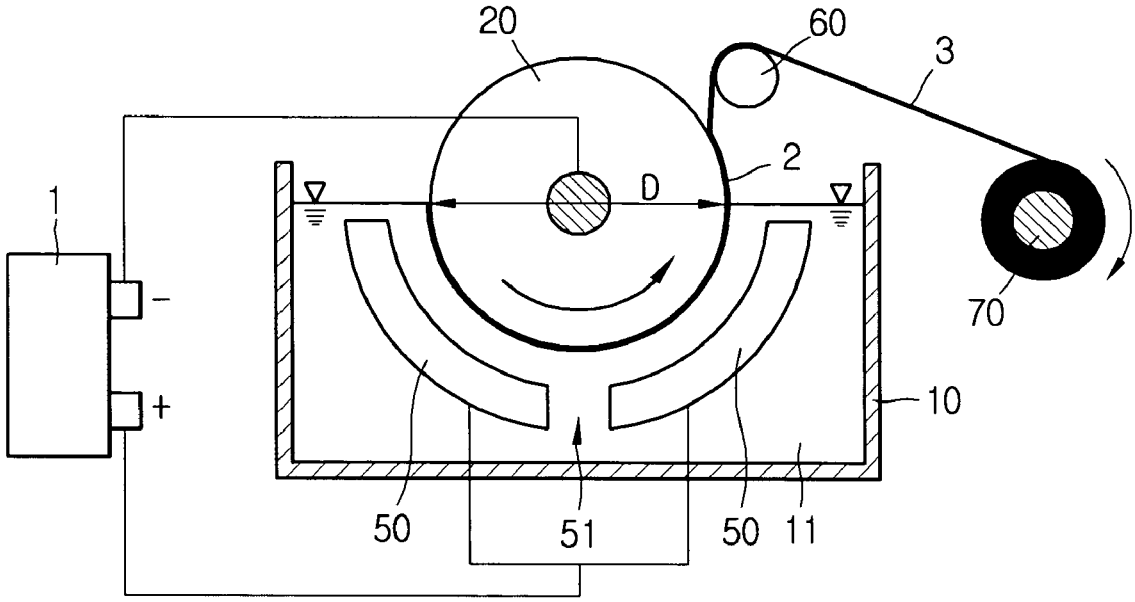
FIG. 1 (PRIOR ART)
FIG. 1 is a sectional view showing a conventional electrolytic metal foil manufacturing device.
Figure 2:
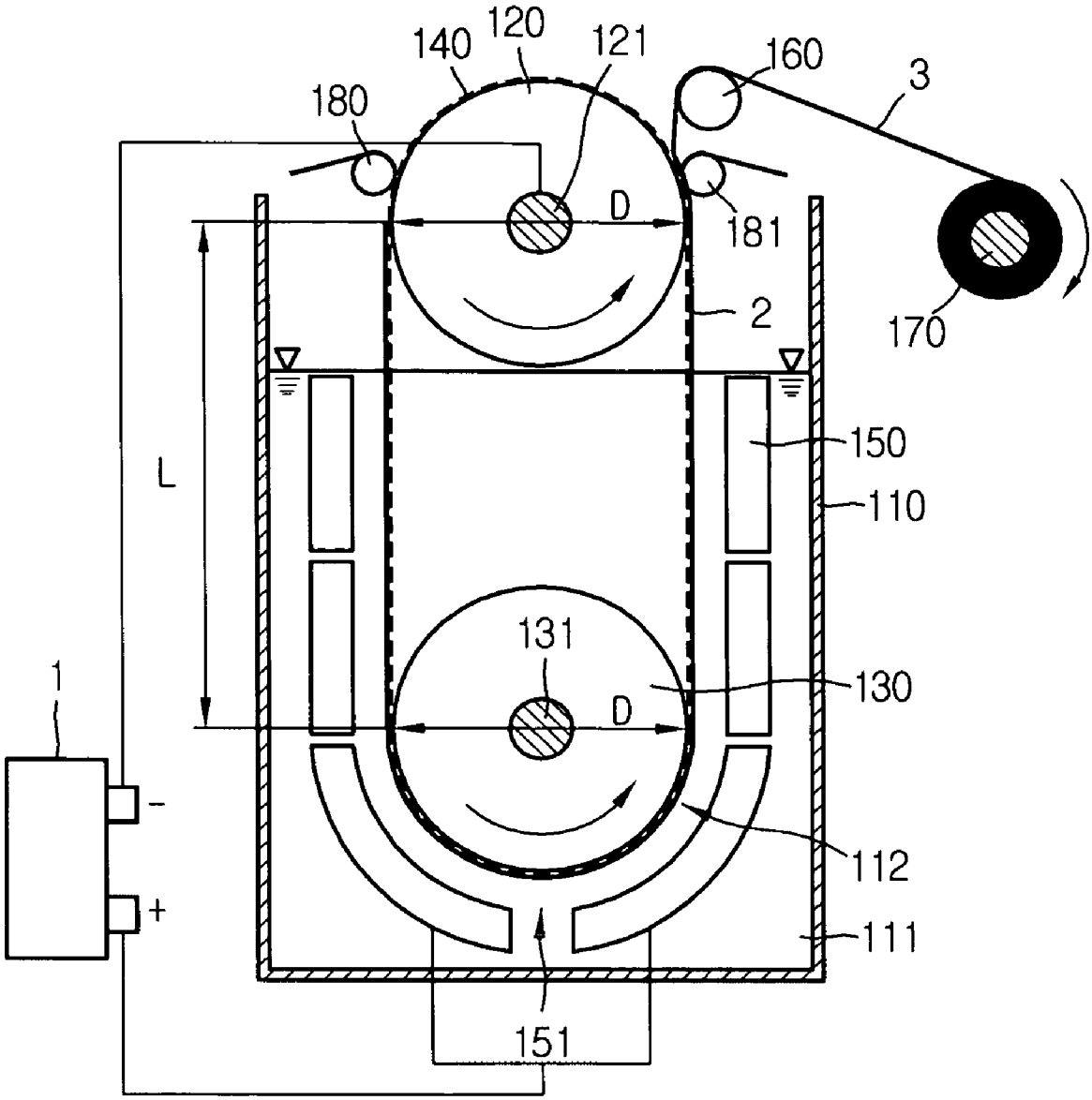
FIG. 2 is a sectional view schematically showing an apparatus for manufacturing an electrolytic metal foil according to a preferred embodiment of the present invention.

FIG. 2 is a sectional view showing an apparatus for manufacturing an electrolytic metal foil according to a preferred embodiment of the present invention.

Referring to FIG. 2, the apparatus for manufacturing an electrolytic metal foil according to this embodiment includes an electrolytic cell 110, an upper drum 120 installed in an upper portion of the electrolytic cell 110, a lower drum 130 installed in the electrolytic cell 110, a cathode belt 140 connecting outer circumferences of the upper drum 120 and the lower drum 130, and an anode unit 150 installed around the cathode belt 140.

The electrolytic cell 110 contains electrolyte 111 and gives an area where electrolytic action arises. In addition, the electrolytic cell 110 has a case shape with an open upper end so that an electrolytic metal foil formed by electrolytic action may be extracted out.

The electrolyte 111 contains metal ions, it is electrolyzed when current is applied to the electrolytic metal foil manufacturing apparatus. In case the apparatus of the present invention is used for manufacturing an electrolytic copper foil that is a kind of electrolytic metal foil, the electrolytic copper foil is made by electroplating copper, so the electrolyte 111 uses a copper ion-contained solution that is mixed with an acid solution. For example, acid copper sulfate solution that is a mixture of copper sulfate solution ($CuSO_4$, $5H_2O$) and sulphuric acid, or acid copper chloride solution that is a mixture of copper chloride ($CuCl_2$) and hydrochloric acid is used. However, the electrolyte to be used for manufacture of an electrolytic copper foil is not limited thereto.

Meanwhile, the kind of electrolyte usable in the apparatus of the present invention is varied depending on a final product. Those with ordinary skill in the art may easily select and use any kind of electrolyte conforming to a metal foil to be manufactured.

The upper drum 120 is installed in the upper portion of the electrolytic cell 110 to be rotatable on a rotary shaft 121 without being soaked in the electrolyte 111, and it is connected to a negative pole of the power source 1.

Preferably, the upper drum 120 is made of conductive titanium that allows flow of electric current and has strong corrosion resistance. However, the present invention is not limited to the above case, and various materials may be used within the scope of the invention by those skilled in the art.

The lower drum 130 is installed to rotate on a rotary shaft 131 with being soaked in the electrolyte 111 contained in the electrolytic cell 110. The lower drum 130 is not connected to the power source, differently from the upper drum 120.

Preferably, the lower drum 130 is made of non-conductive ebonite. However, the present invention is not limited to the above case, and various materials may be used within the scope of the invention by those skilled in the art.

The cathode belt 140 is mounted to an upper circumference of the upper drum 120 and a lower circumference of the lower drum 130 so as to form an endless track in contact with the outer circumferences of the upper and lower drums 120, 130. In this embodiment, the cathode belt 140 moves along an endless track by a driving force of the upper drum 120, and also the cathode belt 140 transmits a rotating force to the lower drum 130. As an alternative, the endless track movement of the cathode belt 140 may also be dragged by means of a rotating force of the lower drum 130.

While the cathode belt 140 makes an endless track movement, the cathode belt 140 is partially soaked in the electrolyte 111 successively. In addition, since the negative (−) pole of the power source 1 is connected to the upper drum 120 as mentioned above, the cathode belt 140 rotating in contact with the upper drum 120 shows a negative (−) electric potential.

The cathode belt 140 preferably has a thickness of 1 to 3 mm so as to easily move along an endless track around the outer circumferences of the upper and lower drums 120, 130.

The anode unit 150 is installed adjacent to a portion of the cathode belt 140 that is soaked in the electrolyte 111. More particularly, the anode unit 150 faces the cathode belt 140 but is spaced apart from the cathode belt 140 by a predetermined distance. Thus, a space 112 is formed between the cathode belt 140 and the anode unit 150.

In addition, a slit 151 is provided to the anode unit 150 so that the electrolyte 111 contained in the electrolytic cell 110 may be introduced into the space 112 between the anode unit 150 and the cathode belt 140. Preferably, a plurality of slits 151 are prepared to facilitate better supply of electrolyte. The anode 150 shows a positive (+) electric potential in connection with the positive pole of the power source 1.

If the negative (−) potential is formed in the cathode belt 140 and the positive (+) potential is formed in the anode unit 150 as mentioned above, electric current flows in the space 112 between the cathode belt 140 and the anode unit 150, and an electrolytic action arises on the surface of the cathode belt 140. That is to say, on the surface of the cathode belt 140, positive metal ions existing in the electrolyte 111 are restored and electroplated on the cathode belt 140.

The electroplated substances 2 electroplated as mentioned above are separated from the cathode belt 140 and then become an electrolytic metal foil. For this purpose, the electrolytic metal foil manufacturing apparatus of the present invention further includes a separating roll 160, and a take-up drum 170 installed out of the electrolytic cell 110 to be rotatable. The electroplated substances 2 are separated from the cathode belt 140 by means of the separating roll 160, and then dried while being transferred to the take-up drum 170. After that, the electroplated substances are taken up by the take-up drum 170 to make an electrolytic metal foil 3.

Meanwhile, the electrolytic metal foil manufacturing apparatus of the present invention may adjust a central length L of the upper and lower drums 120, 130 in various ways. The electrolytic metal foil manufacturing apparatus shown in FIG. 2 is set so that the central length L is about 2 D when each of the upper and lower drums 120, 130 have a diameter D. However, the electrolytic metal foil manufacturing apparatus of the present invention may also be designed so that the central length L of the upper and lower drums 120, 130 has a minimum value, namely D that is a diameter of the drum.

Figure 3:
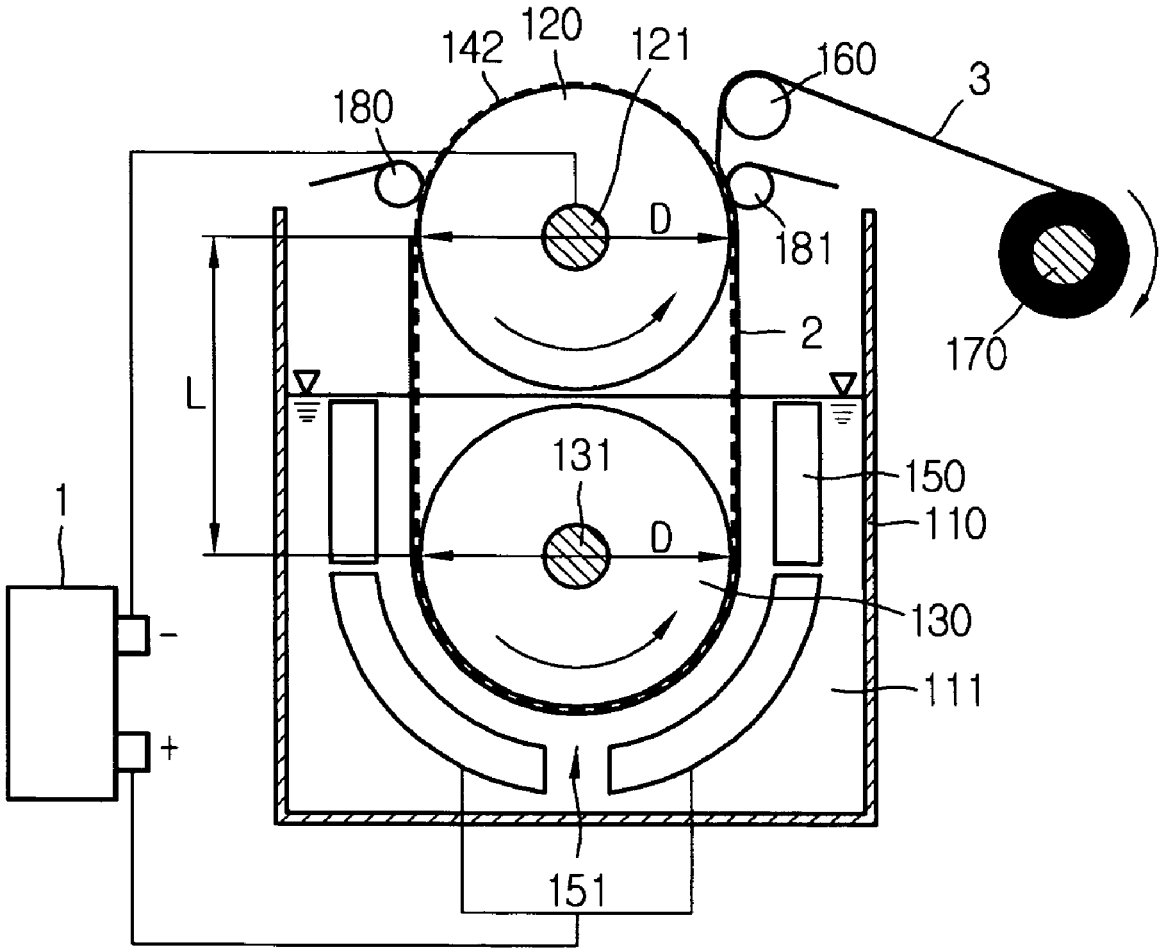
FIG. 3 is a sectional view schematically showing an apparatus for manufacturing an electrolytic metal foil according to another embodiment of the present invention.
Figure 4:
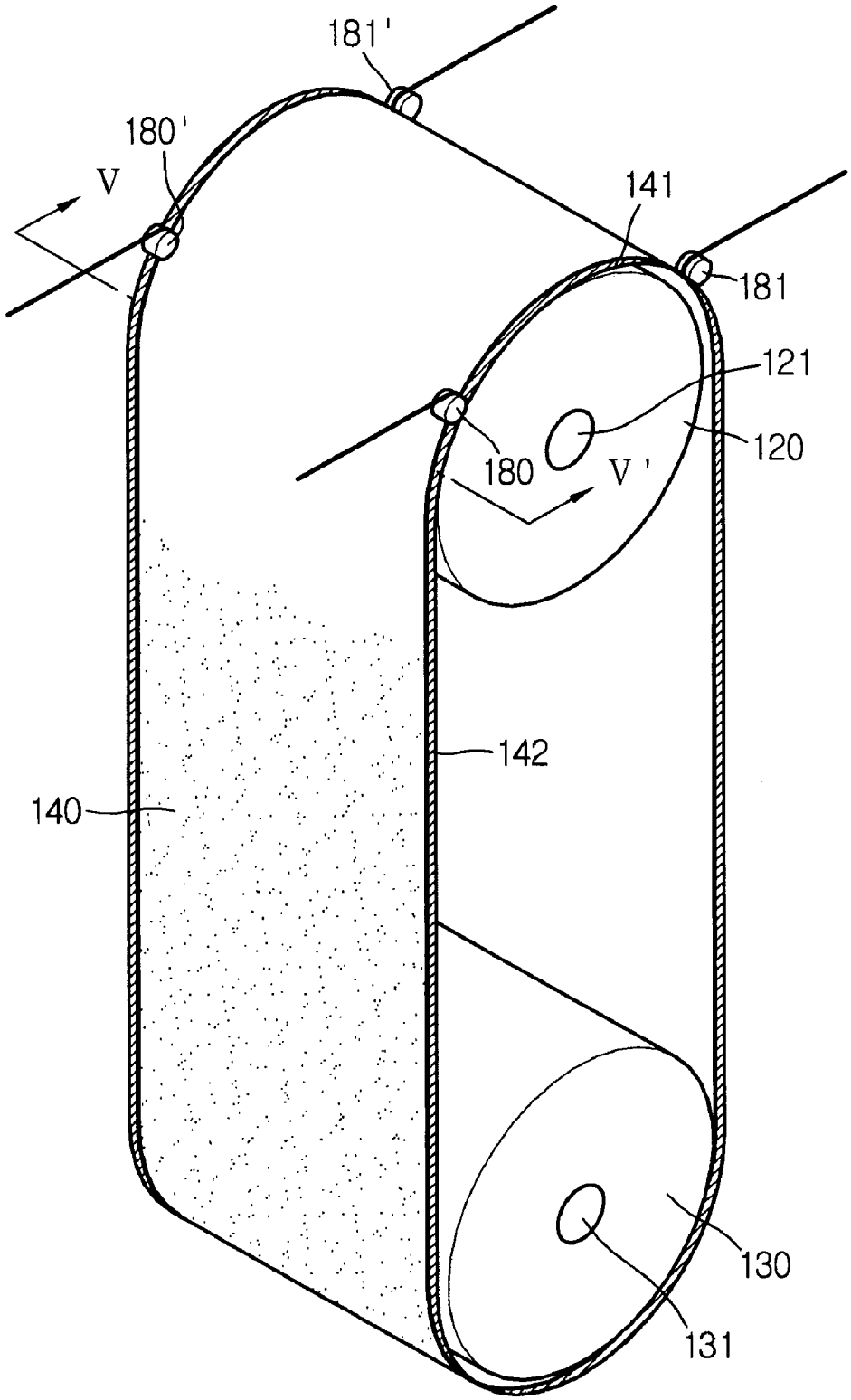
FIG. 4 is a partial perspective view showing a cathode belt employed in the apparatus for manufacturing an electrolytic metal foil according to the present invention.
Figure 5:
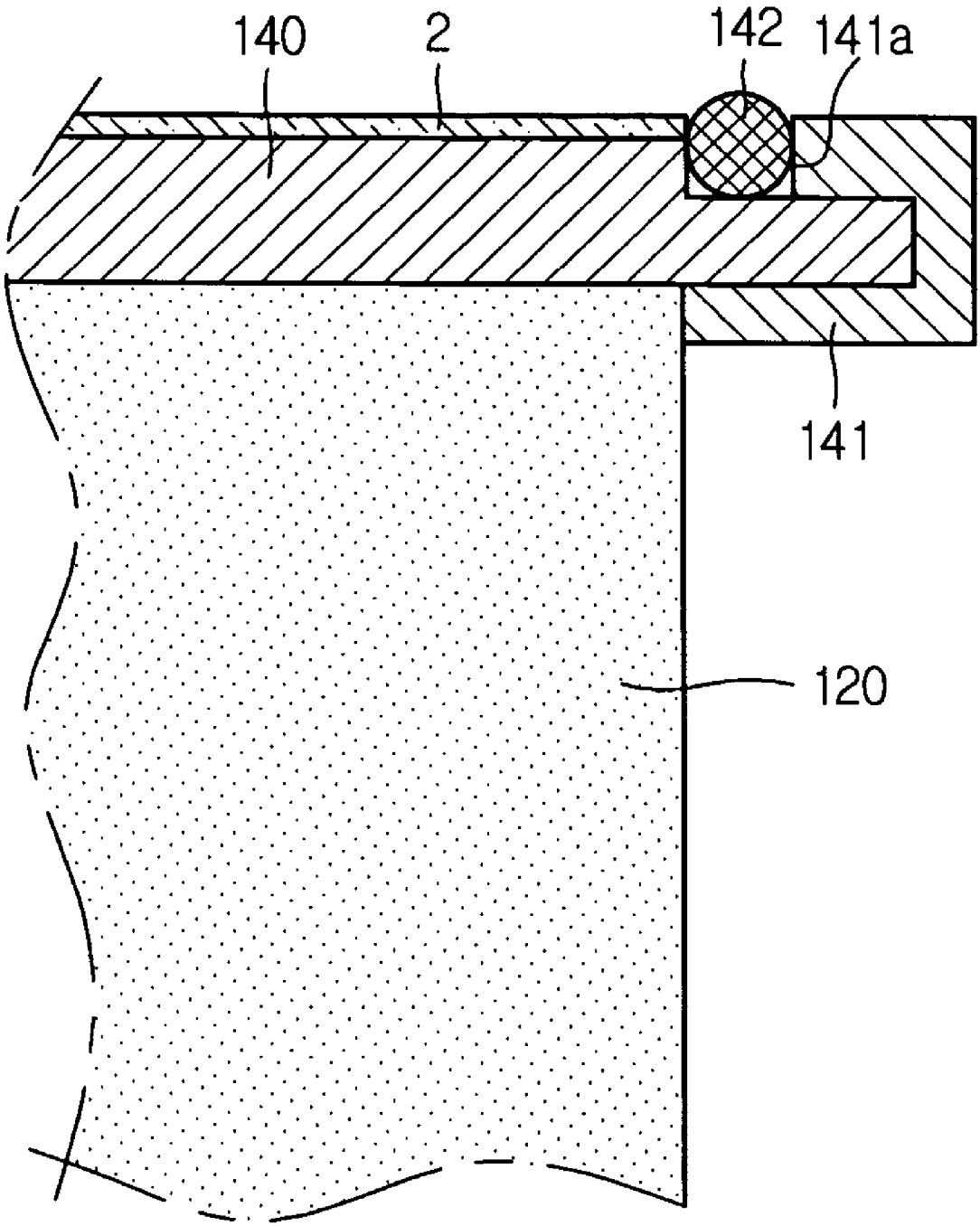
FIG. 5 is a sectional view taken along the line V-V' of FIG. 4.

FIG. 4 is a partial perspective view showing the cathode belt 140 of the electrolytic metal foil manufacturing apparatus according to the present invention, and FIG. 5 is a partial sectional view taken along the line V-V' of FIG. 4. In FIGS. 4 and 5, the same reference numeral as in the former drawings denotes the same component having the same function, and they are not described in detail, as shown in FIG. 3.

Referring to FIGS. 4 and 5, a fixing member 141 is successively installed to right and left side ends of the cathode belt 140. The fixing member 141 is mounted to the upper and lower drums 120, 130 so that the cathode belt 140 moving along an endless track may be continuously rotated smoothly without being deviated from the outer circumferences of the upper and lower drums 120, 130. For this purpose, the fixing member 141 is successively coupled to the entire side end of the cathode belt 140, and also slidably contacted with sides of the upper and lower drums 120, 130.

The fixing member 141 is preferably made of non-conductive material so that, when metal is electroplated on the cathode belt 140, the metal is not electroplated on the surface of the fixing member 141. For example, the fixing member 141 is made of plastic. In addition, the fixing member 141 preferably has a section of "⊂" shape as shown in FIG. 5 to wrap the side of the cathode belt 140 so that the cathode belt 140 may rotate stably. Though specific configuration and material of the fixing member 141 have been explained, the present invention is not limited thereto but various modifications will be possible to those skilled in the art within the scope of the present invention.

Meanwhile, the electroplated substances 2 electroplated on the cathode belt 140 may be contacted with one side 141*a* of the fixing member. In this case, when the electroplated substances 2 are separated from the cathode belt 140 to generate an electrolytic metal foil, both sides of the electrolytic metal foil may not be treated smoothly. For solving this problem, it is preferable that a concave groove is prepared at a border of the electroplated substances 2 and the fixing member 141, and an O-ring 142 is inserted therein.

Preferably, the O-ring 142 is guided by rollers 180, 180' installed in contact with the cathode belt 140 as shown in FIG. 4 so as to be successively inserted into the concave groove. In more detail, before the rotating cathode belt 140 is soaked in the electrolyte 111, the O-ring 142 is inserted into the concave groove by means of the first rollers 180, 180', and if the electroplated substances 2 are moved on a surface of the electrolyte 111 by means of successive rotation of the cathode belt 140, the O-ring 142 is departed from the concave groove by means of second rollers 181, 181'. From this, the electroplated substances 2 are separated from the cathode belt 140, and when the electrolytic metal foil 3 is generated, its side end may be treated smoothly. However, the O-ring may be interposed in other ways, not limited to the above.

Hereinafter, a production rate of the electrolytic metal foil manufacturing apparatus according to the present invention is compared with that of a conventional electrolytic metal foil manufacturing device by means of mathematical calculation.

The example 1 is directed to an electrolytic metal foil manufacturing apparatus having upper and lower drums as shown in FIG. 2 and in which a central length L between the upper and lower drums is 2 D. In addition, the example 2 is directed to an electrolytic metal foil manufacturing apparatus in which a central length L between the upper and lower drums 120, 130 is D as shown in FIG. 3.

The following table 1 shows electroplating rates of the examples 1 and 2 and the conventional one, which are mathematically calculated. All drums have a diameter of D, and a width is W for all drums. Here, t is an electroplating time. In this calculation, π is set to be about 3.14.

Meanwhile, the conventional electrolytic metal foil manufacturing device shows electrolytic actions on the surface of the cathode drum 20 soaked in the electrolyte 11, but the electrolytic metal foil manufacturing apparatus of the present invention shows electrolytic actions on the surface of the cathode belt 140. Thus, an electroplating area is varied depending on the surface height of the electrolyte. In the electrolytic metal foil manufacturing apparatus according to the above examples, a production rate of electrolytic metal foils is calculated on the assumption that the surface of the electrolyte 111 is positioned near to the lower circumference of the upper drum 120. In addition, in the conventional electrolytic metal foil manufacturing device, a production rate of electrolytic copper foils is calculated on the assumption that the surface of the electrolyte 11 is positioned at a substantially central position of the cathode drum 20.

TABLE 1

| | Diameter of Drum | Central Length of Drum | Electroplating Area | Electroplating Rate |
|---|---|---|---|---|
| Example 1 | D | 2D | $(3D + D\pi/2) \times W \approx 4.57D$ | 4.57DW/t |
| Example 2 | D | D | $(D + D\pi/2) \times W \approx 2.57D$ | 2.57DW/t |
| Conventional Device | D | — | $(D\pi/2) \times W \approx 1.57D$ | 1.57DW/t |

Seeing the table 1, an electroplating rate of the electrolytic metal foil manufacturing apparatus of the example 1 is 4.57 DW/t, which is about three times as fast as an electroplating rate of the conventional electrolytic metal foil manufacturing device, which is 1.57 DW/t. In addition, the electrolytic metal foil of the example 2 has a central length L of the upper and lower drums 120, 130 in a minimal level, but its electroplating rate is 2.57 DW/t, which is about 1.6 times as fast as that of the conventional electrolytic metal foil manufacturing device.

Thus, the electrolytic metal foil manufacturing apparatus of the present invention may increase an electroplating rate by enlarging an electroplating area without increasing a diameter of drum, in comparison to a conventional electrolytic metal foil manufacturing device.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

APPLICABILITY TO THE INDUSTRY

As described above, the apparatus for manufacturing an electrolytic metal foil according to the present invention may increase a production rate of electrolytic metal foils by enlarging an electroplating area of electrolyte without increasing an area occupied by equipments under the same density of current.

What is claimed is:

1. An apparatus for manufacturing an electrolytic metal foil, comprising:

an electrolytic cell containing electrolyte;

an upper drum installed in an upper portion of the electrolytic cell to be rotatable and to which a negative (−) electric potential is applied;

a lower drum soaked in the electrolyte of the electrolytic cell and installed to be rotatable together with the upper drum;

a cathode belt mounted around outer circumferences of the upper and lower drums to move along an endless track and electrically connected to the upper drum so that the negative (−) electric potential is applied thereto; and an anode unit installed to form a space from a metal electroplating surface of the cathode belt soaked in the electrolytic cell so that a positive (+) electric potential is applied thereto, the anode unit having a slit for supplying the electrolytic to the space;

a fixing member successively coupled to an entire side end of the cathode belt and slidably contacted with sides of the upper and lower drums;

an O-ring interposed in a concave groove formed at a border between the fixing member and an electroplated metal electroplated on the cathode belt;

a first roller for guiding the O-ring to be successively inserted into the concave groove before the cathode belt is soaked in the electrolyte; and a second roller for guiding the O-ring to be successively departed from the concave groove when the cathode belt moves up above a surface of the electrolyte.

2. The apparatus for manufacturing an electrolytic metal foil according to claim 1, wherein the upper drum is made of conductive titanium.

3. The apparatus for manufacturing an electrolytic metal foil according to claim 1, wherein the lower drum is made of non-conductive ebonite.

4. The apparatus for manufacturing an electrolytic metal foil according to claim 1, wherein the cathode belt has a thickness of 1 to 3 mm.

5. The apparatus for manufacturing an electrolytic metal foil according to claim 1, wherein the fixing member is made of non-conductive material.

6. The apparatus for manufacturing an electrolytic metal foil according to claim 1, wherein the fixing member has a section of a '⊂' shape to surround a side of the cathode belt.

7. The apparatus for manufacturing an electrolytic metal foil according to claim 1, further comprising:

a separating roll installed out of the electrolytic cell to separate the metal electroplated on the cathode belt from the cathode belt; and a take-up drum for taking up the separated electrolytic metal foil.

* * * * *